US006092319A

United States Patent [19]

Hicks

[11] Patent Number: 6,092,319

[45] Date of Patent: Jul. 25, 2000

[54] APPARATUS FOR CONNECTING ADVERTISING SUBSTRATE TO TRUCKS

[76] Inventor: Charles H. Hicks, 13908 Lake Point Dr., Clearwater, Fla. 33762

[21] Appl. No.: 09/059,654

[22] Filed: Apr. 13, 1998

[51] Int. Cl.[7] ..... G09F 17/00

[52] U.S. Cl. ..... 40/603; 40/590

[58] Field of Search ..... 40/590, 603, 604, 40/792; 160/90, 329, 378

[56] References Cited

U.S. PATENT DOCUMENTS

| | | | |
|---|---|---|---|
| 4,580,361 | 4/1986 | Hillstrom et al. | 160/378 X |
| 5,058,299 | 10/1991 | Suzuki | 40/603 |
| 5,142,804 | 9/1992 | Hillstrom et al. | 40/603 |
| 5,349,772 | 9/1994 | Pardue | 40/603 X |
| 5,398,436 | 3/1995 | Suzuki | 40/604 X |
| 5,415,451 | 5/1995 | Stanton | 40/590 X |
| 5,649,390 | 7/1997 | Davidson | 40/603 X |
| 5,845,423 | 12/1998 | Hicks | 40/603 |
| 5,893,226 | 4/1999 | Sophocleous et al. | 40/603 X |

*Primary Examiner*—Brian K. Green
*Attorney, Agent, or Firm*—Ronald E. Smith; Smith & Hopen, P.A.

[57] ABSTRACT

A substrate upon which an advertising message may be imprinted is secured in overlying relation to an overhead-opening type of truck or trailer rear door by an assembly that includes an elongate coil spring positioned on an interior side of the overhead door. The lowermost end of the spring is secured to the interior side of the door and the uppermost end of the coil spring is connected to a lower end of a winch by a nonstretchable strap. The upper end of the winch is connected by a nonstretchable strap to a rigid rod to which the upper end of the substrate is attached. Tightening the winch increases the tautness of the substrate and loosening the winch decreases the tautness. When properly adjusted, the substrate is taut throughout the entire door-raising and lowering procedure, even though the substrate is substantially nonstretchable and even though the opening of the door requires the substrate to extend a greater distance than when the door is closed. The difference in length is compensated for by the coil spring when its resistance is properly adjusted by the winch. An apparatus including opposed, "L"-shaped brackets that are interconnected and drawn toward one another by an elongate bolt tightens the forward ends of side-covering substrates when clearance space is limited between a cab and the cargo-receiving part of a truck or trailer.

2 Claims, 4 Drawing Sheets

APPARATUS FOR CONNECTING ADVERTISING SUBSTRATE TO TRUCKS

BACKGROUND OF THE INVENTION

1. Field of the Invention

This invention relates, generally, to means for connecting to trucks or similar vehicles flexible substrates upon which advertising messages may be printed. More particularly, it relates to an apparatus for connecting such a substrate in overlying relation to the rear wall of a truck having an overhead-opening door and to an apparatus for tightening the respective leading ends of opposing, side wall-covering substrates when only a narrow space is available.

2. Description of the Prior Art

The present inventor has provided heretofore a substrate adapted to be secured to the side walls of a truck. He has also provided a means for securing such a substrate to the back wall of a truck of the type having doors that swing open about a vertical hinge.

However, a mounting means for securing a substrate to a back wall of a truck or trailer of the type having an overhead-opening door has not heretofore been disclosed.

As used herein, the term "truck or trailer" refers to trucks of all types, including full trailers (where all of the weight is borne by a single chassis) and semi-trailers (where the weight is shared between the tractor chassis and the trailer chassis). It includes those vehicles where the cargo-receiving part is just a few inches behind the cab or tractor and it further includes those vehicles where the cargo-receiving part thereof is spaced a foot or more from the tractor or cab, as in most semi-trailers.

Doors of the overhead type are formed by a collection of panels that are hingedly connected to one another by vertically spaced apart horizontally-extending hinges. When an overhead door is opened, its panels ride in a curved track until all panels are in a horizontal disposition near the top of the truck or trailer when the door is fully open. The distance between the top edge of the uppermost panel and the lower edge of the lowermost panel is greater when the door is open than when the door is closed. As a result, if a substrate is tightly secured in overlying relation to such a door when the door is closed, the substrate must stretch several inches along its height when the door is opened. Thus, after such a stretching has taken place, the substrate will be loose when the door is closed if the substrate is not perfectly elastic, i.e., if the substrate lacks sufficient resilience to return to its pre-stretched state.

However, durable material of the type suitable for use as a substrate upon which high quality advertising messages may be imprinted is substantially nonstretchable. Accordingly, alternate means must be found that will allow such a substrate to be used with an overhead door. Such means should not require stretching of the substrate.

More specifically, there is a need for an assembly of parts that tightly secures a substantially nonstretchable substrate in overlying relation to a truck or trailer door of the overhead-opening type, and which allows the door to be opened and closed without requiring the substrate to stretch when the door is opened or contract when the door is closed.

Another problem is extent in the field of trucks or trailers where the cab occupied by the driver is positioned closely to the cargo-receiving part of the truck or trailer. In those trucks or trailers where there is ample space between the forward or front wall of the cargo-receiving part of the truck or trailer and the back wall of the cab, relatively large winches or equivalent devices may be employed to draw together the respective forward edges of the substrates that overlie the respective side walls of the cargo-receiving part of the truck or trailer because the clearance space between the cab and the cargo-receiving part is usually several feet; a person can stand in front of the winches and operate them without physical space restrictions. Such winches cannot be mounted or easily accessed, however, when advertising messages are imprinted upon substrates that are attached to the side walls of trucks or trailers having limited space, such as just a few inches, between the cab and the front wall of the cargo-receiving part of the truck or trailer.

Thus there is a need for a means for tightening the respective forward edges of substrates that overlie the side walls of a truck or trailer of the type having little clearance between the cab and the cargo-receiving part thereof. The tightening means should be easily operable even in the very small space between a cab back wall and the front wall of the cargo-receiving part of the truck or trailer.

However, in view of the art considered as a whole at the time the present invention was made, it was not obvious to those of ordinary skill in this art how the needed improvements could be provided.

SUMMARY OF THE INVENTION

The long-standing but heretofore unfulfilled need for an apparatus that overcomes the limitations of the prior art is now met by a new, useful, and nonobvious invention. The present invention is an apparatus for holding an uppermost or leading end of a substrate that overlies an exterior surface of an overhead-type door in such a way that the substrate is taut when the door is open, closed, or any position therebetween, even though the substrate is substantially nonstretchable and even though the distance the substrate must extend when the door is open is greater than the distance it must extend when the door is closed.

More particularly, the novel apparatus for holding a substrate that overlies an exterior surface of an overhead-type door includes means for securing a lowermost end of the substrate to the exterior surface of the overhead door, a winch means, a first substantially nonstretchable interconnecting means for interconnecting a first end of the winch means to the uppermost end of the substrate, a bias means, a second substantially nonstretchable interconnecting means for interconnecting a first end of the bias means to the winch means, and a third substantially nonstretchable interconnecting means for interconnecting a second end of the bias means to the overhead door.

Increasingly tightening the winch means therefore pulls the substrate into increasingly more taut overlying relation to the exterior surface of the overhead door. Increasingly loosening the winch means increasingly introduces more slack into the substrate so that it more loosely overlies the exterior surface of the overhead door.

In this way, the bias means contracts or expands to maintain the substrate in a substantially taut configuration as the overhead door is raised and lowered.

The first substantially nonstretchable interconnecting means is preferably a strap member or similar means that extends between the first end of the winch means and the uppermost end of the substrate.

The second substantially nonstretchable interconnecting means is preferably a strap member or similar means that extends between the second end of the winch means and the first end of the bias means.

The third substantially nonstretchable interconnecting means is preferably an eye hook having a base that is screwthreadedly engaged to the interior surface of the overhead door. The eye hook has an eye part that is engaged by the second end of the bias means.

The bias means is preferably an elongate, vertically disposed coil spring.

Accordingly, the winch adjusts the tension of the bias means and the properly adjusted bias means contracts or expands to maintain the substrate in a substantially taut configuration, in overlying relation to an exterior surface of the door, as the overhead door is raised and lowered. In this way, the substrate itself need not contract or expand.

The invention further includes an apparatus for pulling toward one another a pair of opposing, vertically-extending forward edges of substrates that respectively overlie opposite side walls of a truck or trailer. The apparatus includes a pair of opposing "L"-shaped brackets. Each bracket of the pair of brackets has a first leg and a second leg disposed substantially normal to one another, with the respective first legs overlying the front wall of the cargo-receiving part of the truck or trailer and the respective second legs being disposed perpendicularly to said front wall in upstanding relation thereto. A strap-receiving slot is formed in respective first legs of the brackets, and a bolt-receiving aperture is formed in the respective second legs of the brackets. An elongate bolt extends in interconnecting relation between the respective second legs of the brackets; the elongate bolt has first and second ends that respectively extend through the bolt-receiving apertures in the respective second legs of the brackets. A nut or internally-threaded boss means is nonrotationally engaged to the second leg of a first bracket and screwthreadedly receives a first end of the elongate bolt. A second end of the elongate bolt includes a tool-engageable head which overlies the second leg of the second bracket. Accordingly, rotation of the elongate bolt by rotating its tool-engageable head with a suitable tool results in drawing the first and second brackets and hence the straps and hence the forward edges of the opposing substrates toward one another, thereby removing slack from the part of the substrates that overlie the opposite sidewalls of the cargo-receiving part of the truck or trailer.

A socket wrench and an elongate extension member for selectively engaging the tool-engageable head of the elongate bolt is included so that the opposing vertical edges of the respective substrates may be pulled toward one another even if a clearance space between a cab or tractor and a forward wall of the cargo-receiving part of the truck or trailer is relatively small.

A brace or gusset extends between the first and second legs of each bracket to maintain said first and second legs in normal relation to one another when the elongate bolt is tightened. The bracket may be integrally formed as by stamping or the like so that the gusset part thereof is not separately formed from the first and second legs thereof.

It is a primary object of this invention to provide a means for securing an advertising substrate to the rear wall of a truck or trailer of the type having an overhead door.

Another object is to provide a tightening means for pulling together the vertical front edges of substrates that overlie sidewalls of a truck or trailer.

A more specific object is to provide such a tightening means that has a low clearance requirement so that it can be operated in the small space between the cab and the front wall of a cargo-receiving part of some trucks or trailers.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
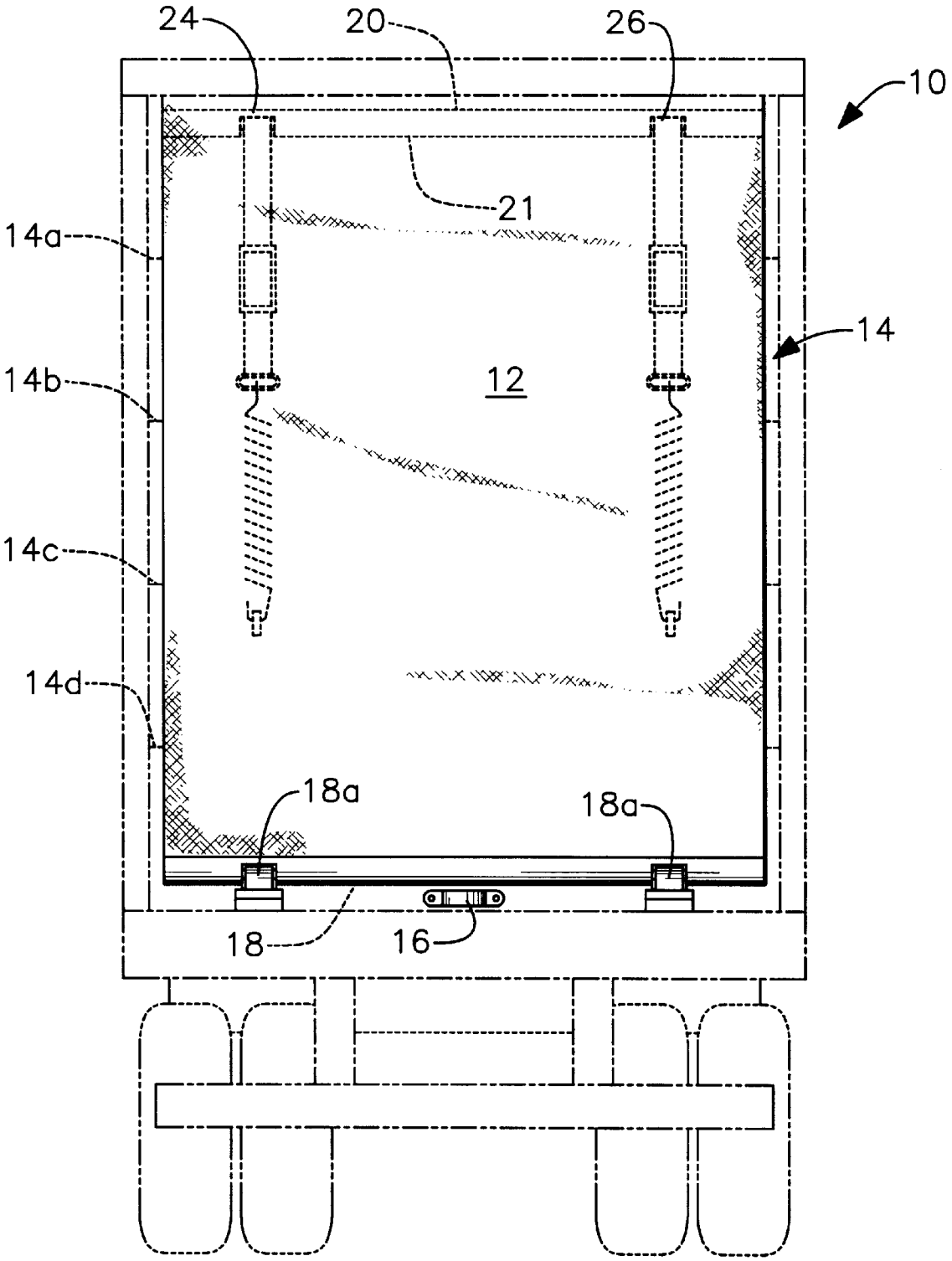
FIG. 1 is a rear elevational view of an illustrative embodiment of an overhead-type rear door of a truck or trailer equipped with a substrate.

Referring now to FIG. 1, it will there be seen that an exemplary embodiment of the invention is denoted as a whole by the reference numeral 10.

Substrate 12 overlies the exterior surface of rear door 14 of the overhead type; the five hinged-together sections of this particular door are unnumbered to avoid cluttering the drawings. The four horizontally-disposed hinges are denoted 14*a*, 14*b*, 14*c*, and 14*d*.

Door 14 is raised in the well-known way by grasping handle 16 and lifting the door in a vertical direction so that it glides upwardly and inwardly in tracks, not shown. As the door is opened, the panels sequentially change from a vertical position to a horizontal position, as is well-known; said panels are closely spaced to a top wall of the cargo-receiving part of the truck or trailer when the door is fully open.

Horizontally-extending bottom edge 18 of substrate 12 is hemmed to form a pocket and fixedly held in its depicted position by an assembly of parts (18*a* in FIGS. 1 and 4) disclosed in a co-pending patent application filed by the present inventor on Apr. 30, 1997 bearing Ser. No. 08/846,602 entitled "Advertising Substrate Flush Mountable To Trucks," which application is hereby incorporated by reference in its entirety into this disclosure.

Figure 4:
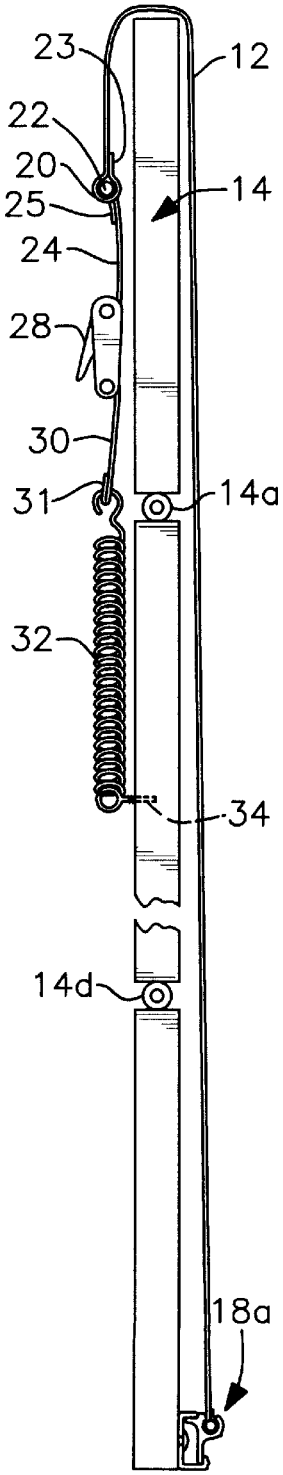
FIG. 4 is a side elevational view of the novel substrate-tensioning assembly when an overhead door is in its closed configuration.
Figure 5:
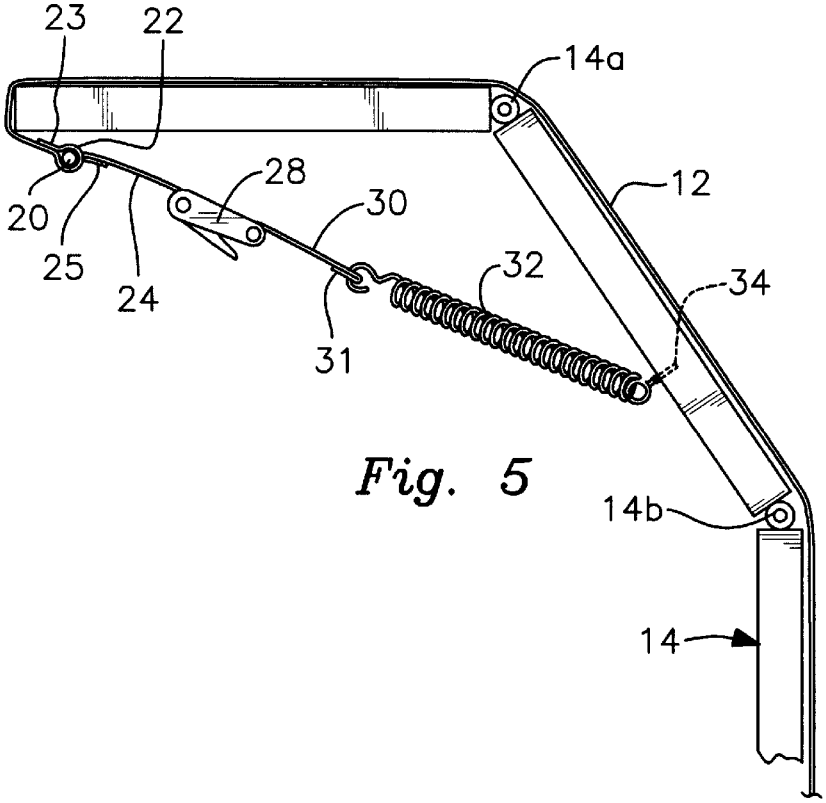
FIG. 5 is a side elevational view of the novel substrate-tensioning assembly when the overhead door of FIG. 4 is in transition between its fully open position and its fully closed position.

Horizontally-extending top edge 20 has a hem 23 formed therein, as indicated by dotted line 21; the pocket formed by the hem is best depicted in FIGS. 4 and 5. A rigid rod 22, also depicted in FIGS. 4 and 5, is slideably received within said pocket. Strap 24 is looped at its first or upper end as at 25; a similar loop is formed in strap 26. Said loops receive said rigid rod 22. The hem of the substrate is cut away in the vicinity of said loops of said straps 24, 26, respectively, to accommodate rigid rod 22.

Figure 2:
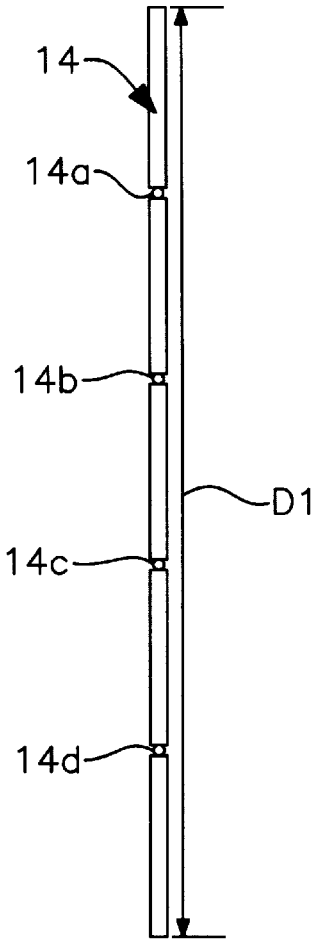
FIG. 2 is a side elevational view of an overhead door when in its closed configuration.
Figure 3:
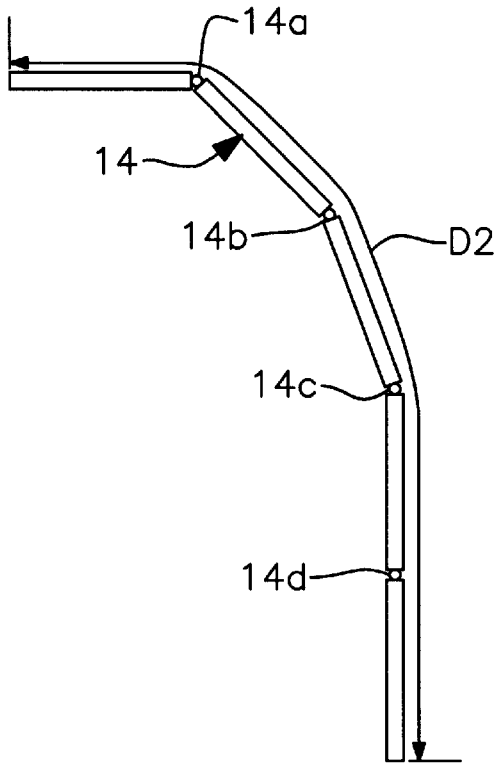
FIG. 3 is a side elevational view of the overhead door of FIG. 2 when in transition between its fully closed and its fully open configuration.

Before considering FIGS. 4 and 5 in detail, an examination of FIGS. 2 and 3 will explain why the novel structure is needed. When door 14 is in its closed configuration, as depicted in FIG. 2, the distance from the top edge of the top panel to the bottom edge of the bottom panel is denoted D1. When door 14 is in transition between its FIG. 1 position and its fully open position, Distance D2 (FIG. 3), which is also defined as the distance from the top edge of the top panel to the bottom edge of the lowermost panel, is greater than D1. Thus, substrate 12 must either flex and stretch whenever door 14 is not in its fully closed position, or some other part of the apparatus must do so if the substrate is substantially nonstretchable, as it is here.

In the side elevational view of FIGS. 4 and 5, only strap 24 is depicted but it should be understood that the same assembly of parts is associated with strap 26. Strap 24 extends from rigid rod 22 to a first end of a winch means 28 that performs a bias-adjusting function as will become clear as this description proceeds. Another strap, denoted 30, extends from a second end of winch means 28 to a first end of an elongate coil spring or bias means 32; loop 31 is suitably apertured to facilitate interconnection of strap 30 and said bias means 32. The second end of bias means 32 is secured to door 14 by any suitable means. As depicted, an eye bolt 34 has a base that is screw-threadedly engaged to door 14, and said second end of bias means 32 engages the eye part of said eye-hook 34.

To adjust the amount of bias provided by bias means 32, winch means 28 is manually operated in the well-known way to pull substrate 12 taut while door 14 is in its FIG. 4 position. Door 14 is then opened; if substrate 12 is too taut, it will prevent the door panels from rotating with respect to hinges 14*a*, 14*b*, 14*c* and 14*d*. Winch 28 is then operated to loosen the tension on strap 30 and the process is repeated until the right amount of tension is provided. If too little tension is provided, substrate 12 will droop when door 14 is closed.

Since winch 28 or its equivalent is easy to operate, and since bias means 32 offers a wide range of resistance, the adjustment process is fast and easy. Accordingly, substantially nonstretchable substrate 12 need not stretch and contract as door 14 is opened and closed because bias means 32 expands or contracts instead and maintains an appropriate tautness on said substrate at all positions of door 14.

The means for holding the vertically-extending forward and rearward ends of substrate panels that overlie the side walls of a truck or trailer are disclosed in the above-referenced co-pending disclosure. Significantly, said forward and rearward ends wrap around the respective corners of the cargo-receiving part of the truck or trailer so that wind cannot get underneath the substrate panels.

Figure 6:
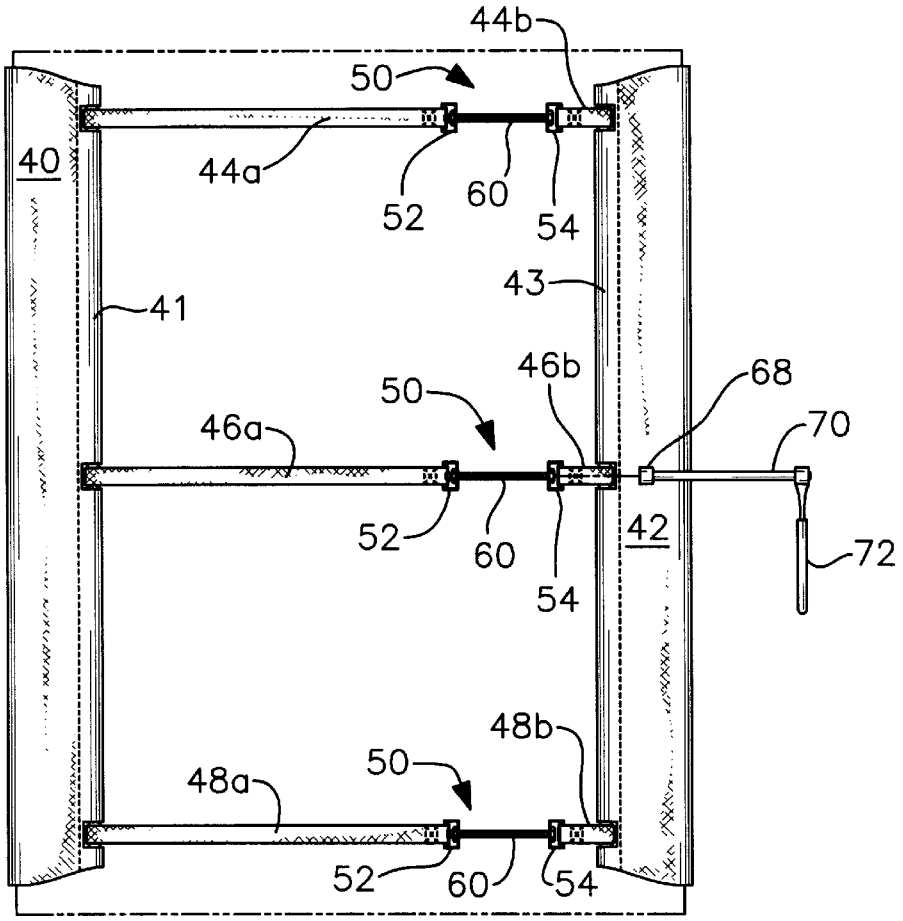
FIG. 6 is a front elevational view of the tightening means for pulling together opposed forward vertical edges of opposing substrates when very little clearance space is available between a front wall of a cargo-receiving part of a truck or trailer and the rear wall of a cab.

As depicted in FIG. 6, the respective forward ends of a pair of substrate panels are denoted 40 and 42, respectively. A pocket-forming hem 41, 43 is sewn or otherwise formed into the respective leading ends of said panels, and an elongate rigid rod means is slideably received within each of said pockets. Horizontally-extending straps 44*a*, 44*b*, 46*a*, 46*b* and 48*a*, 48*b* are looped at their respective outermost ends and engage said rigid rod means in the same way that straps 24, 26 (FIGS. 4 and 5) engage the rigid rod means that is received within the hem formed at the uppermost end of substrate 12.

Figure 7:
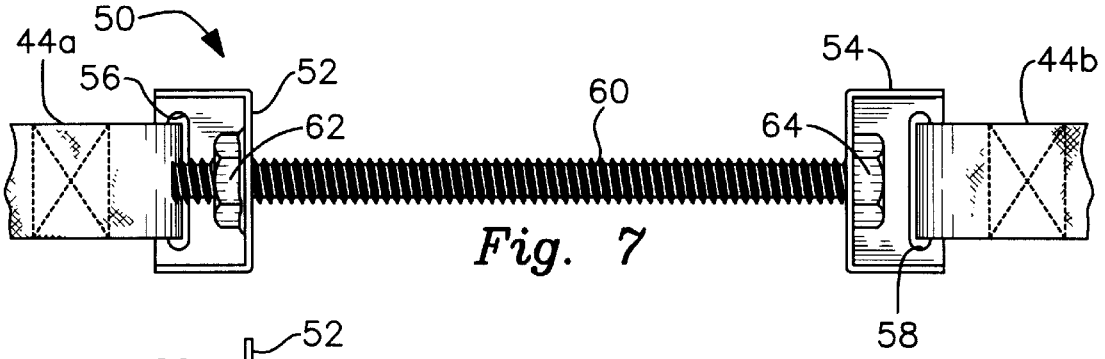
FIG. 7 is a detailed front elevational view of the tightening means depicted in FIG. 6.
Figure 8:
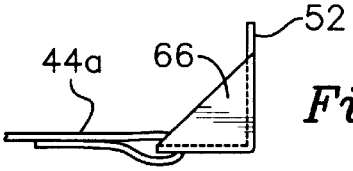
FIG. 8 is a top plan view of a strap and a brace that form a part of the novel tightening means.

The opposing ends of said straps are respectively interconnected by a novel substrate-tensioning means 50 which is best depicted in FIGS. 7 and 8.

Tensioning means 50 performs the same function as performed by the corresponding tensioning means disclosed in the above-referenced co-pending disclosure. However, the earlier tensioning means cannot be used in trucks or trailers of the type having limited space between the cab and the cargo-receiving part of the truck or trailer. Thus, tensioning means 50 of this invention is a low-profile tensioning means that can be used where very little clearance space is available; it may also be used where clearance space is ample.

Tensioning means 50 includes a pair of rigid, "L"-shaped brackets 52, 54. A first leg of each bracket overlies the vertical front wall of the cargo-receiving part of a truck or trailer and is slotted as at 56, 58, respectively, to receive respective looped free ends of straps 44*a*, 44*b*. A second leg of each bracket stands perpendicularly with respect to said front wall and each second leg is centrally apertured to receive an elongate threaded bolt. A first end of bolt 60 is screw-threadedly engaged to nut or boss means 62 which is nonrotationally secured to its associated second leg. A second end of said bolt has a tool-engageable head that abuts its associated second leg. Accordingly, tightening bolt 60 by rotating head 64 with a suitable tool results in drawing straps 44*a*, 44*b* toward one another, thereby tightening the respective substrates that overlie the side walls of the cargo-receiving part of the truck or trailer.

As depicted in FIG. 8, a flat brace or gusset 66 extends between the legs of the "L"-shaped bracket to strengthen it, i.e., to prevent the bracket from straightening out when bolt 60 is tightened.

As depicted in FIG. 6, a bolt head-engaging socket 68 has an elongate extension 70 the free end of which is engaged by a socket wrench 72. Thus, a person standing beside the truck or trailer employs wrench 72 in the well-known way to tighten bolt 60. The respective second legs of brackets 52, 54 are therefore understood to have a very low profile or longitudinal extent, i.e., each of said legs extends from the plane of the paper no more than an inch or two, thereby easily fitting in the small space provided between the cab and the cargo-receiving part of some trucks or trailers. Since an extension member such as extension member 70 is equally narrow in breadth, i.e., easily insertable through a space of only a few inches in width, it is clear that the novel apparatus performs its intended function.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus in combination with substantially nonstretchable substrate adapted to overlie an exterior surface of an overhead-type door, comprising:

mounting means adapted to secure a lowermost end of said substantially nonstretchable substrate to said exterior surface of said overhead-type door;

said substantially nonstretchable substrate having an uppermost end adapted to extend over an uppermost edge of said overhead-type door to a predetermined position adjacent an interior surface of said door;

a hem formed in said uppermost end of said substantially nonstretchable substrate;

an elongate rigid rod disposed within said hem;

a winch adapted to be disposed adjacent said interior surface of said overhead-type door;

a first substantially nonstretchable strap member for interconnecting a first end of said winch to said rigid rod;

a bias means adapted to be disposed adjacent said interior surface of said overhead-type door;

a second substantially nonstretchable strap member for interconnecting a first end of said bias means to a second end of said winch;

an eye hook having a base that is adapted to screwthreadedly engage said interior surface of said overhead door, said eye hook having an eye part that is engaged by a second end of said bias means;

said substantially nonstretchable substrate being drawn taut when said winch is operated in a first direction and being loosened when said winch is operated in a second direction;

said bias means adapted to contract or expand to maintain said substantially nonstretchable substrate in a substantially taut configuration as said overhead-type door is raised and lowered.

2. The apparatus of claim 1, wherein said bias means is an elongate, vertically disposed coil spring.

* * * * *